US008482361B2

(12) United States Patent
Udagawa et al.

(10) Patent No.: US 8,482,361 B2
(45) Date of Patent: Jul. 9, 2013

(54) WAVEGUIDE POWER DIVIDER HAVING COUPLING SLOTS BETWEEN STACKED WAVEGUIDE PORTIONS AND METHOD OF MANUFACTURE

(75) Inventors: Shigeo Udagawa, Tokyo (JP); Mitsuru Kirita, Tokyo (JP); Makoto Koukuwano, Kanagawa (JP)

(73) Assignee: Mitsubishi Electric Corporation, Tokyo (JP)

( * ) Notice: Subject to any disclaimer, the term of this patent is extended or adjusted under 35 U.S.C. 154(b) by 342 days.

(21) Appl. No.: 12/866,083

(22) PCT Filed: Mar. 9, 2009

(86) PCT No.: PCT/JP2009/054456
§ 371 (c)(1),
(2), (4) Date: Aug. 4, 2010

(87) PCT Pub. No.: WO2009/119298
PCT Pub. Date: Oct. 1, 2009

(65) Prior Publication Data

US 2010/0315178 A1 Dec. 16, 2010

(30) Foreign Application Priority Data

Mar. 25, 2008 (JP) ..... 2008-079182

(51) Int. Cl.
*H01P 5/12* (2006.01)

(52) U.S. Cl.
USPC ..... 333/125; 333/137; 333/113

(58) Field of Classification Search
USPC ..... 333/113, 114, 125, 137; 343/771, 343/776
See application file for complete search history.

(56) References Cited

U.S. PATENT DOCUMENTS

| | | | | |
|---|---|---|---|---|
| 2,632,809 | A * | 3/1953 | Riblet | 333/113 |
| 2,852,752 | A * | 9/1958 | McCreary | 333/33 |
| 2,883,628 | A * | 4/1959 | Heinard | 333/113 |
| 3,537,037 | A | 10/1970 | Brumbaugh | |
| 4,797,995 | A | 1/1989 | Chang et al. | |
| 5,428,322 | A | 6/1995 | Hendrick et al. | |
| 7,804,381 | B2 | 9/2010 | Stafford | |
| 2008/0186110 | A1 | 8/2008 | Stafford | |

FOREIGN PATENT DOCUMENTS

| | | | |
|---|---|---|---|
| CN | 1377099 | A | 10/2002 |
| CN | 1926714 | A | 3/2007 |
| CN | 1949590 | A | 4/2007 |
| EP | 1753085 | A1 | 2/2007 |

(Continued)

OTHER PUBLICATIONS

Office Action issued Aug. 14, 2012 in Japanese Patent Application No. 2010-505513 with English language translation.

(Continued)

*Primary Examiner* — Benny Lee
(74) *Attorney, Agent, or Firm* — Oblon, Spivak, McClelland, Maier & Neustadt, L.L.P.

(57) ABSTRACT

A coupling slot 10 provided in a wide wall shared by a first rectangular waveguide 8 and a second rectangular waveguide 9 arranged by stacking is formed by directing a longitudinal direction of the coupling slot 10 to a tube axial direction, and a matching conductor 11 projecting to a waveguide near the coupling slot 10 is provided on one sidewall of the second rectangular waveguide 9. A process of providing the matching conductor 11 is easy, a structure that can be manufactured at low cost is obtained, and a power distribution ratio can be set at an arbitrary ratio.

7 Claims, 3 Drawing Sheets

FOREIGN PATENT DOCUMENTS

| | | | |
|---|---|---|---|
| JP | 57 131101 | | 8/1982 |
| JP | 59 132203 | | 7/1984 |
| JP | 4 117703 | | 4/1992 |
| JP | 2000-261239 | A | 9/2000 |
| JP | 2000-513553 | A | 10/2000 |
| JP | 2005-159767 | | 6/2005 |
| JP | 2005 159767 | | 6/2005 |
| JP | 2007 67581 | | 3/2007 |
| JP | 2007-228313 | A | 9/2007 |
| JP | 2007-244015 | A | 9/2007 |
| WO | WO 2006/027588 | A1 | 3/2006 |

OTHER PUBLICATIONS

Office Action issued on Sep. 29, 2012 in counterpart Chinese Application No. 200980110394.3 (5 pages).

Extended European Search Report issued Nov. 7, 2012 in Patent Application No. 09725148.2.

* cited by examiner

WAVEGUIDE POWER DIVIDER HAVING COUPLING SLOTS BETWEEN STACKED WAVEGUIDE PORTIONS AND METHOD OF MANUFACTURE

TECHNICAL FIELD

The present invention relates to a waveguide power divider used for distributing or combining electromagnetic waves of a microwave band and a millimeter wave band, and a method for manufacturing the same.

BACKGROUND ART

A waveguide power divider used in a feed circuit of an array antenna is preferably able to set its power distribution ratio to an arbitrary ratio. For example, as a conventional waveguide power divider meeting this demand, the invention described in Patent Document 1 is known.

That is, the conventional waveguide power divider capable of setting a power distribution ratio to an arbitrary ratio is configured such that a first rectangular waveguide and a second rectangular waveguide are arranged by stacking in parallel, both waveguides are connected by a coupling window of which longitudinal direction is orthogonal with a tube axis, and that a short thin-wall portion is provided in the second rectangular waveguide.

The conventional waveguide power divider can set a power distribution ratio to an arbitrary ratio by displacing a center of the coupling window from a center of the thin-wall portion.

Patent Document 1: Japanese Patent Application Laid-open No. 2005-159767 (FIGS. 6 and 7)

SUMMARY OF THE INVENTION

Problem to be Solved by the Invention

However, the conventional waveguide power divider described above requires a complex process to provide the thin-wall portion in the second rectangular waveguide, and thus it has a problem of high manufacturing costs.

The present invention has been achieved in view of the above problems, and an object of the present invention is to provide a waveguide power divider which is capable of setting a power distribution ratio to an arbitrary ratio at a low cost and also in an easily manufacturable structure, and a method of manufacturing the waveguide power divider.

Means for Solving Problem

To achieve the object, a waveguide power divider according to one aspect of the present invention is constructed by having a first rectangular waveguide and a second rectangular waveguide arranged by stacking to set mutual tube axes in parallel and share a wide wall, having a coupling slot provided on the shared wide wall, having one side end in a tube axial direction of the first rectangular waveguide set as a short-circuit surface at a position exceeding the coupling slot in the tube axial direction, and having three ports constituted by a side of the other side end of the first rectangular waveguide and each side end of both sides in a tube axial direction of the second rectangular waveguide, wherein the coupling slot is formed by having its longitudinal direction directed to a tube axial direction, and a matching conductor projected to a duct near the coupling slot is provided on one sidewall of the second rectangular waveguide.

Effect of the Invention

According to the present invention, a waveguide power divider capable of setting a power distribution ratio to an arbitrary ratio at a low cost and in an easily manufacturable structure can be obtained.

EXPLANATIONS OF LETTERS OR NUMERALS

Figure 1:
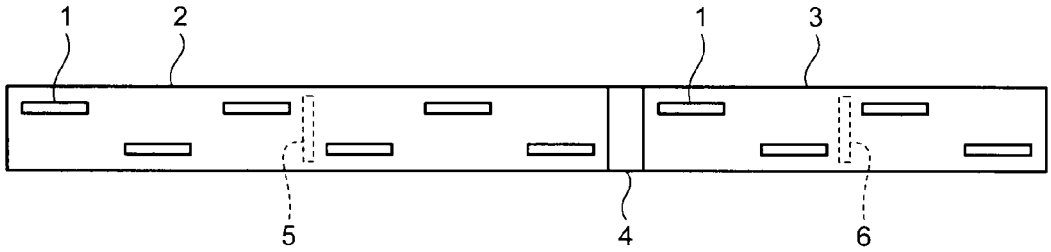
FIG. 1 is a front view showing an example of a waveguide slot-array antenna in which a waveguide power divider is used.

1 Radiating slot
2, 3 Radiating waveguide
4 Feed circuit
5, 6 Coupling slot
7 Waveguide power divider
8 First rectangular waveguide
9 Second rectangular waveguide
10 Coupling slot
11 Matching conductor
12 Short-circuit surface

BEST MODE(S) FOR CARRYING OUT THE INVENTION

Exemplary embodiments of a waveguide power divider and a method for manufacturing the same according to the present invention will be explained below in detail with reference to the accompanying drawings. The present invention is not limited thereto.

Figure 2:
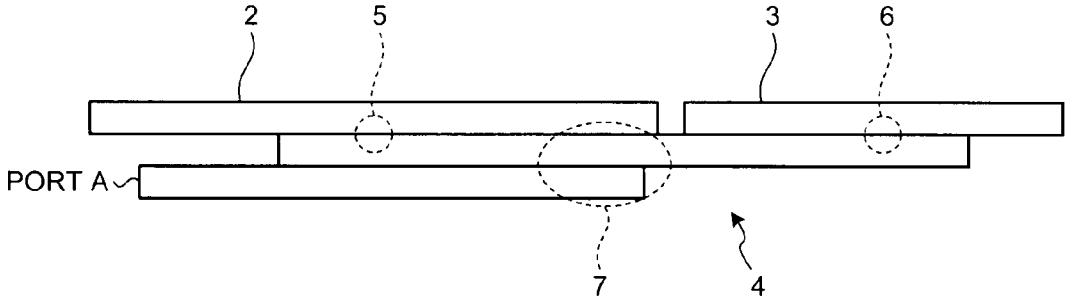
FIG. 2 is a side view of the waveguide slot-array antenna shown in FIG. 1.

FIG. 1 is a front view showing an example of a waveguide slot-array antenna in which a waveguide power divider is used. FIG. 2 is a side view of the waveguide slot-array antenna shown in FIG. 1.

The waveguide slot-array antenna shown in FIGS. 1 and 2 is configured by radiating waveguides 2 and 3 having radiating slots 1 (FIG. 1) provided on one wide wall surface (a front surface), and a feed circuit 4 that feeds electromagnetic waves from the other wide wall surface (a back surface) to the radiating waveguides 2 and 3. Although FIGS. 1 and 2 are an example of a configuration formed by two radiating waveguides, there is also a case that the waveguide slot-array antenna is configured by an odd number of radiating waveguides.

The radiating waveguide 2 and the feed circuit 4 are electromagnetically connected to each other by a coupling slot 5, and the radiating waveguide 3 and the feed circuit 4 are electromagnetically connected to each other by a coupling slot 6. The feed circuit 4 has a waveguide power divider 7 and a port A as shown in FIG. 2. In the example shown in exemplary FIG. 1, the radiating slots 1 are provided by six elements on the front surface of the radiating waveguide 2, and the radiating slots 1 are provided by four elements on the front surface of the radiating waveguide 3. Although the radiating waveguides 2 and 3 are arranged in a separated manner in the drawings, these waveguides can be integrally connected. In the case that these waveguides are integrally connected, a conductor wall or an electromagnetic shield is provided between the radiating waveguide 2 and the radiating waveguide 3 to avoid an electromagnetic interference between them.

In the above configuration, electromagnetic waves of a microwave band or a millimeter wave band input to the port A are distributed to two directions by the waveguide power divider 7. Electromagnetic waves in one direction are fed to the radiating waveguide 2 through the coupling slot 5, and excite six radiating slots 1 provided on the front surface of the radiating waveguide 2. Electromagnetic waves in the other direction are fed to the radiating waveguide 3 through the coupling slot 6, and excite four radiating slots 1 provided on the front surface of the radiating waveguide 3.

In this case, the numbers of the radiating slots 1 are different between the radiating waveguides 2 and 3. However, even in this case, the waveguide power divider 7 is also required to have a capability capable of distributing electric power capable of exciting all of the radiating slots 1 at a uniform amplitude. This power distribution capability is also required when there are an odd number of radiating waveguides having the same number of radiating slots. Therefore, the waveguide power divider 7 used in the feed circuit 4 is preferably able to set a power distribution ratio to an arbitrary ratio.

Figure 3:
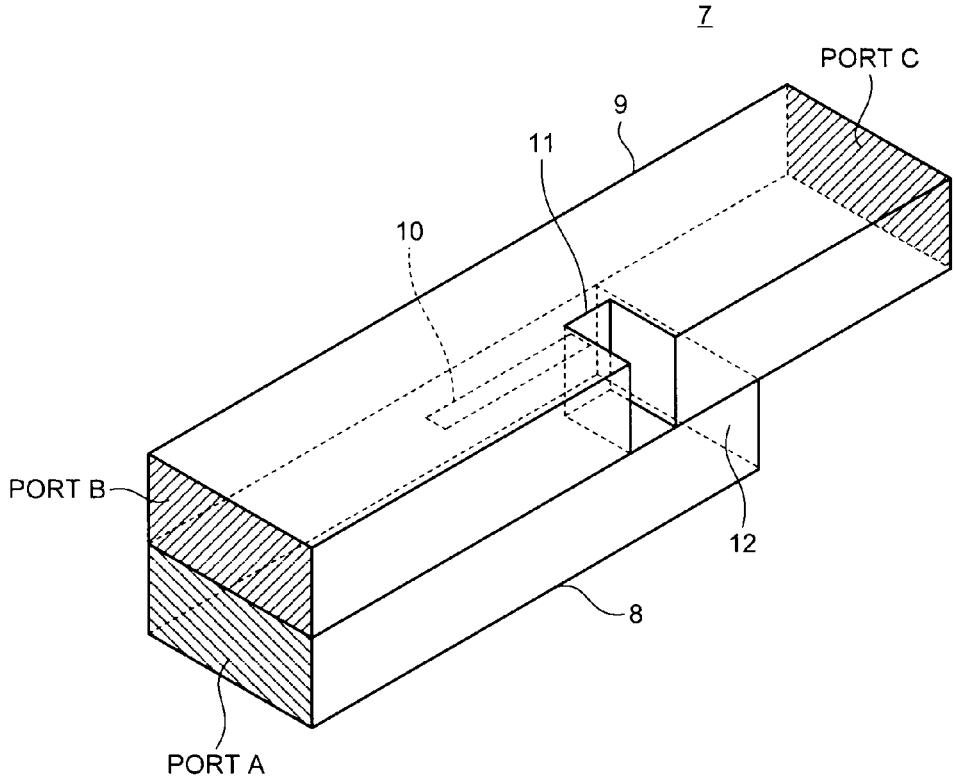
FIG. 3 is a perspective view showing a configuration of a waveguide power divider according to an embodiment of the present invention.
Figure 4:
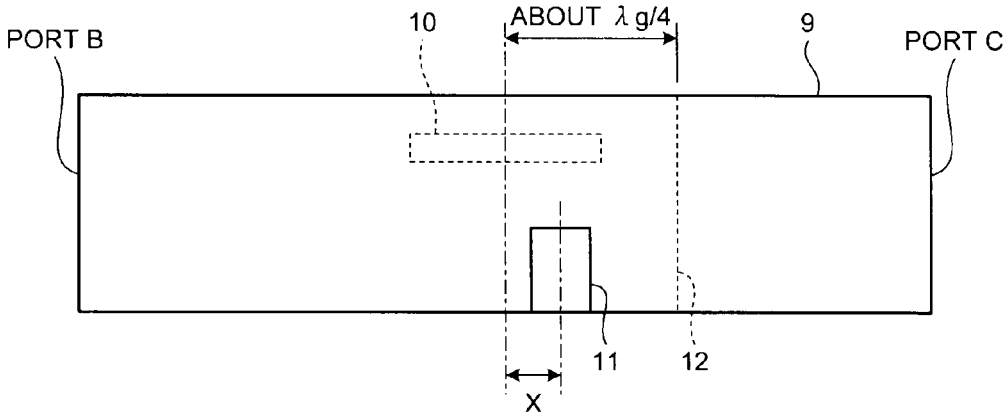
FIG. 4 is a top view of the waveguide power divider shown in FIG. 3.

A waveguide power divider according to the present embodiment that can set a power distribution ratio to an arbitrary ratio is explained in detail below. FIG. 3 is a perspective view of a configuration of the waveguide power divider according to an embodiment of the present invention. FIG. 4 is a top view of the waveguide power divider shown in FIG. 3 that also shows port B and port C.

(Configuration of a Waveguide Power Divider According to this Embodiment)

As shown in FIG. 3, the waveguide power divider 7 according to the present embodiment has a first rectangular waveguide 8 and a second rectangular waveguide 9 arranged by stacking to have mutual tube axes in parallel and to share a wide wall. In FIG. 3, the second rectangular waveguide 9 is mounted on the first rectangular waveguide 8.

The first rectangular waveguide 8 has one end in a tube axial direction opened and communicated with the port A, and has the other end in the tube axial direction blocked as a short-circuit surface 12. The second rectangular waveguide 9 has both ends in the tube axial direction opened to form ports B and C, respectively.

A coupling slot 10 is provided on the shared wide wall. In FIG. 3, the coupling slot 10 is formed to have its longitudinal direction directed to a tube axial direction at one end in a short-side direction of the shared wide wall. As shown in FIG. 4, a longitudinal-direction center of the coupling slot 10 is provided at a position distanced by about $\lambda g/4$ ($\lambda g$ is a waveguide wavelength) from the short-circuit surface 12 of the first rectangular waveguide 8 (FIG. 3).

A matching conductor 11 is provided near the coupling slot 10 within the second rectangular waveguide 9 as shown in FIG. 3. Specifically, in the example shown in FIG. 3, the matching conductor 11 is provided in a projecting manner toward the coupling slot 10 side on a sidewall at the other end side in a short-side direction of the wide wall of the second rectangular waveguide 9. The matching conductor 11 is provided at a position offset by a distance X (FIG. 4) from the center of the coupling slot 10 in a longitudinal direction. It suffices that the matching conductor 11 is projected into a duct of the second waveguide 9. Although FIG. 3 depicts a mode in which the matching conductor 11 has a trench, it can be solid without any trench part.

As for the size, in a case of a 76-GHz band waveguide power divider, both the first rectangular waveguide 8 and the second rectangular waveguide 9 have 2.6 millimeters for a short-side direction width of the wide wall, and 1.2 millimeters for the height of a sidewall.

(Operation of Waveguide Power Divider Configured as Described Above)

Electromagnetic waves of a microwave band and a millimeter wave band input to the port A (FIG. 3) are propagated to a tube axial direction directed to the short-circuit surface 12 in the first rectangular waveguide 8, and excite the coupling slot 10. The excited coupling slot 10 generates electromagnetic waves in the second rectangular waveguide 9. The electromagnetic waves generated in the second rectangular waveguide 9 are propagated to both sides of the tube axial direction in the second rectangular waveguide 9, and are output from the port B and the port C.

In this case, the power ratio of the port B to the port C as shown in FIG. 4 can be set to an arbitrary ratio based on a position of the matching conductor 11, that is, the offset distance X. That is, when the offset distance X is 0, that is, when the center position of the matching conductor 11 is matched with the longitudinal-direction center of the coupling slot 10, equal power is distributed to the port B and the port C. When the offset distance X is set to a positive value, that is, when the center position of the matching conductor 11 is at a position shifted from the longitudinal-direction center of the coupling slot 10 toward a port C side, the distribution ratio to the port B becomes high. On the other hand, when the offset distance X is a negative value, that is, when the center position of the matching conductor 11 is at a position shifted from the longitudinal-direction center of the coupling slot 10 toward a port B side, the distribution ratio to the port C becomes high. It is preferred that the offset distance X is adjusted within a range of a slot length (a longitudinal direction length) of the slot 10.

Figure 5:
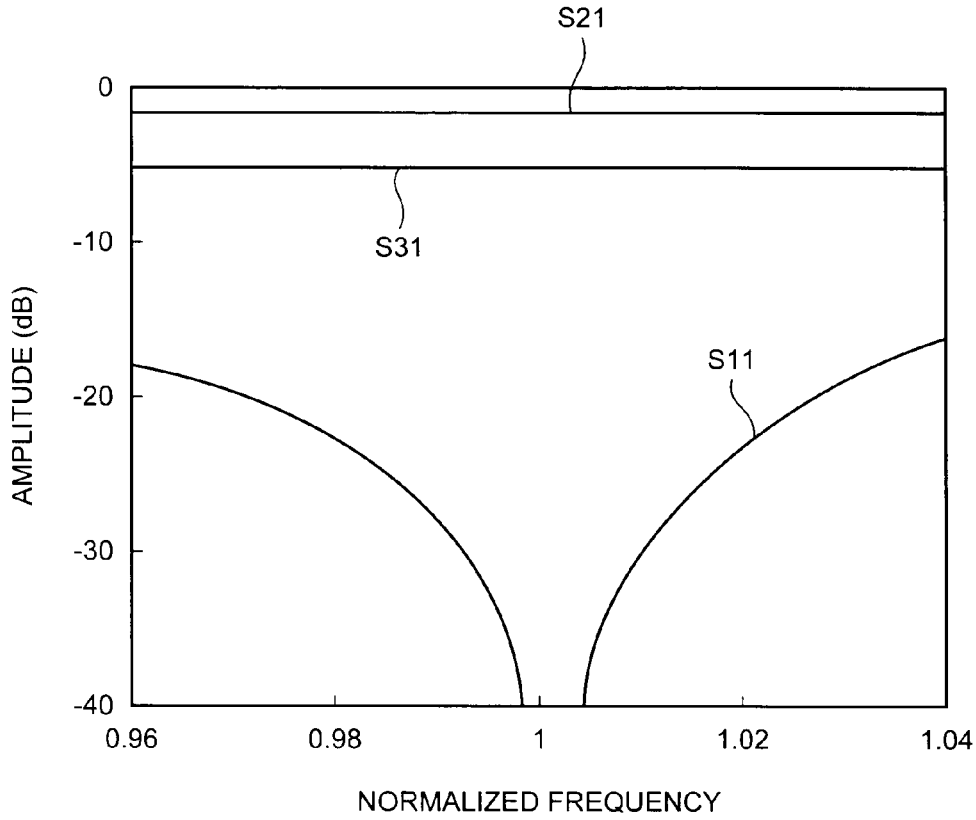
FIG. 5 is a characteristic diagram showing a result of an electromagnetic field simulation.

FIG. 5 is a characteristic diagram showing a result of an electromagnetic field simulation. In FIG. 5, the vertical axis shows amplitude and the horizontal axis shows normalized frequency. Reference numeral S11 denotes a reflection characteristic of the port A, reference numeral S21 denotes a transmission characteristic from the port A to the port B, and reference numeral S31 denotes a transmission characteristic from the port A to the port C, respectively. Reference numeral S11 is equal to or lower than −20 decibels over a fractional bandwidth 6%. Reference numerals S21 and S31 are characteristics flat to a frequency. Reference numeral S21 is −1.6 decibels, and reference numeral S31 is −5.1 decibels. The power ratio of this relationship is 2.2:1. It can be understood that a desired power distribution ratio is obtained.

While the above operation is for a case of inputting electromagnetic waves to the port A and distributing the electromagnetic waves to the port B and the port C, because waveguide power dividers are reciprocal in general, the above operation can be also used to combine power. That is, when electromagnetic waves of the same frequency are input to the port B and the port C, these are combined at a predetermined ratio, and are output from the port A.

While a case of using an inductive iris for the matching conductor 11 is described in the present embodiment, a conductive post or a conductive block can be also used, and similar effects can be obtained. Generally, the matching conductor 11 can be processed more easily than a waveguide thin-wall portion of a conventional technique. Therefore, the waveguide power divider according to the present embodiment can be manufactured at a cost lower than that of conventional waveguide power dividers.

(Configuration and Method for Manufacturing Waveguide Power Divider According to the Embodiment)

Because the waveguide power divider 7 shown in FIG. 3 is in a mode that the first rectangular waveguide 8 and the second rectangular waveguide 9 share one wide wall, the waveguide power divider 7 can be divided into three parts including a shared wide-wall portion in which the coupling slot 10 is provided, and parts of the first and second rectangular waveguides 8 and 9 from which the shared wide wall is excluded.

Therefore, when the waveguide power divider of the mode shown in FIG. 3 is manufactured, for example, there is considered a method of cutting a U-shaped trench of the first rectangular waveguide, a U-shaped trench of the second rectangular waveguide, and the coupling slot, respectively in three aluminum sheet materials, and bonding them by brazing. However, with this method, there are problems such that the cost of processing and bonding is high, a brazing material sticks out, and the size changes due to the brazing.

Accordingly, in the present embodiment, the waveguide power divider is manufactured by using diffusion bonding capable of bonding without using any brazing material. Diffusion bonding is a bonding method of heating and pressing members to be bonded, and metallurgically integrating the members by using a diffusion phenomenon generated between bonded surfaces. The diffusion bonding uses a principle that metallic binding is formed when metal surfaces are connected to each other to a distance of about an atomic level. Therefore, in principle, two metals can be bonded together when they are brought close to each other.

Therefore, the bonding cost in manufacturing can be reduced by using diffusion bonding. Furthermore, because any brazing material is not used, there is no problem of sticking out, and there is an advantage that deformation due to bonding hardly occurs.

Figure 6:
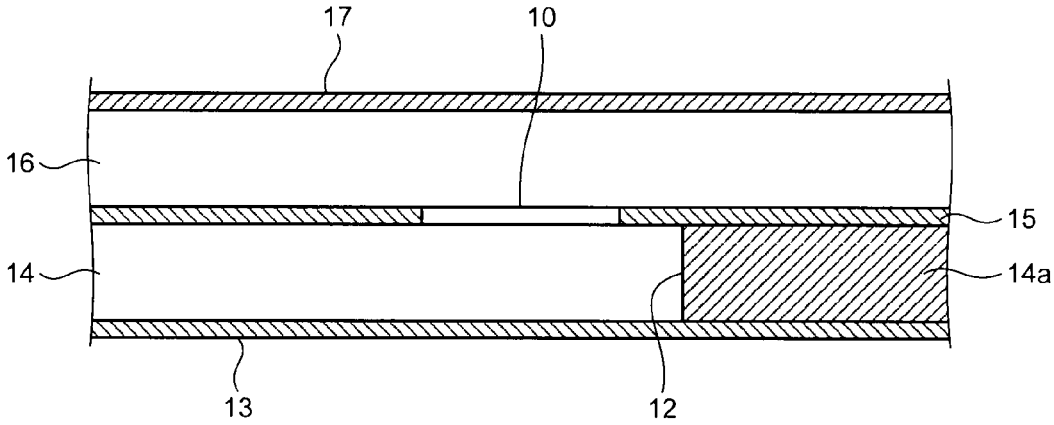
FIG. 6 is a partial cross-sectional view for explaining a structure and a manufacturing method when diffusion bonding is applied to manufacturing of the waveguide power divider shown in FIG. 3.

FIG. 6 is a partial cross-sectional view for explaining a structure and a manufacturing method when diffusion bonding is applied to manufacturing of the waveguide power divider shown in FIG. 3.

(Structure)

The waveguide power divider shown in FIG. 3 can be configured by five metal sheets including a first metal sheet 13, a second metal sheet 14, a third metal sheet 15, a fourth metal sheet 16, and a fifth metal sheet 17, as shown in FIG. 6. Sizes of the five metal sheets are arbitrary, and it suffices that the sizes are as large as those capable of securing a short-side direction width of a wide wall and capable of securing a necessary duct-line length. With regard to an example of the above size, it suffices that the size exceeds the short-side direction width of 2.6 millimeters of the wide wall. The five metal sheets can be stainless steel sheets, for example.

The first metal sheet 13 is a metal sheet that becomes a wide wall facing a shared wide wall of the first rectangular waveguide 8 (FIG. 3). The fifth metal sheet 17 is a metal sheet facing the shared wide wall of the second rectangular waveguide 9. The third metal sheet 15 is a metal sheet that becomes a wide wall (a shared wide wall) shared by the first and second rectangular waveguides 8 and 9, and is formed with the coupling slot 10. The sheet thickness of each of these three metal sheets is arbitrary, and can be smaller than the sheet thickness of the second metal sheet 14 or the fourth metal sheet 16.

The second metal sheet 14 is a metal sheet to form a tube-axial-direction duct space excluding both wide wall sides of a cross-section square duct of the first rectangular waveguide 8, and is provided with a slit having a gap between both sidewalls of the first rectangular waveguide 8 as a slit width in a tube axial direction. The short-circuit surface 12 shown in FIG. 6 is an end of this slit, and the portion of reference character 14*a* shown at the right side thereof represents a portion not formed with a slit. The sheet width of the second metal sheet 14 that determines the height of a sidewall is 1.2 millimeters in the example of the size mentioned above. The slit width that determines a short-side direction width of the wide wall is 2.6 millimeters in the example of the size mentioned above.

The fourth metal sheet 16 is a metal sheet to form a tube-axial-direction duct space excluding both wide wall sides of a cross-section square duct of the second rectangular waveguide 9, and is provided with a slit having a gap between both sidewalls of the second rectangular waveguide 9 as a slit width in a tube axial direction. Although not shown in FIG. 6, the matching conductor 11 is formed in a projecting manner into the slit in the middle of the slit. The sheet width of the fourth metal sheet 16 that determines the height of a sidewall is 1.2 millimeters in the example of the size mentioned above. The slit width that determines a short-side direction width of the wide wall is 2.6 millimeters in the example of the size mentioned above.

(Manufacturing Method)

In FIG. 6, the first metal sheet 13, the second metal sheet 14, the third metal sheet 15, the fourth metal sheet 16, and the fifth metal sheet 17 in the configuration described above are prepared. Because all of these metal sheets have a two-dimensional shape and can be applied with etching or press working, necessary members can be prepared at a low cost.

Next, positioning is performed such that a longitudinal direction of the coupling slot 10 provided in the third metal sheet 15 is in parallel with a tube axial direction, the slit provided in the second metal sheet 14 and the slit provided in the fourth metal sheet 16 are in parallel with each other in the tube axial direction, a matching conductor part provided in the slit of the fourth metal sheet 16 is positioned near the coupling slot 10, and that an end of the slit provided in the second metal sheet 14 is located at a position of about ¼ of a waveguide wavelength distanced from a longitudinal-direction center of the coupling slot 10.

In a state that such positioning is performed, the waveguide power divider 7 shown in FIG. 3 is formed by performing diffusion bonding by sequentially stacking from the first metal sheet 13 to the fifth metal sheet 17 in this order.

Although FIG. 6 depicts a case that a metal sheet that constitutes the first rectangular waveguide 8 and the second rectangular waveguide 9 is a metal sheet capable of obtaining a necessary height in a sheet thickness by one sheet, the necessary height can be also obtained by stacking the metal sheets in plural. Although the above embodiment has explained a case that a waveguide cross-sectional size of the first rectangular waveguide 8 and that of the second rectangular waveguide 9 are the same, these cross-sectional sizes can be different. In this case of different sizes, the height and width at a wide wall side of the first rectangular waveguide 8 and the second rectangular waveguide 9 are determined individually.

As described above, because the waveguide power divider is configured by dividing it into plural metal sheets, each of the metal sheets has a two-dimensional shape, and can be processed at a low cost by etching or pressing. Furthermore, because these metal sheets are bonded by diffusion bonding, mass production becomes possible at a low cost and in stable quality.

INDUSTRIAL APPLICABILITY

As described above, the waveguide power divider according to the present invention is useful as a waveguide power divider capable of setting a power distribution ratio to an arbitrary ratio at a low cost and in an easily manufacturable structure. In addition, the method for manufacturing a waveguide power divider according to the present invention is useful as a manufacturing method for mass production at a low cost and in stable quality.

The invention claimed is:

1. A waveguide power divider having a first rectangular waveguide portion and a second rectangular waveguide portion bonded together in a stacked arrangement with the first rectangular waveguide portion and the second rectangular waveguide portion extending in parallel along a common longitudinal direction, the first rectangular waveguide portion and the second rectangular waveguide portion sharing a common wide wall there between having a coupling slot provided through the shared common wide wall, the first rectangular waveguide portion having an end portion set as a short-circuit surface at a position located beyond the coupling slot position in the common longitudinal direction, the waveguide power divider further having three ports formed, respectively, as an open end of the first rectangular waveguide portion opposed to the end portion thereof set as the short-circuit surface and open ends at opposite sides in the common longitudinal direction of the second rectangular waveguide portion, wherein the coupling slot is formed by providing a slot direction in parallel to the common longitudinal direction, and a matching conductor projected into the second rectangular waveguide portion near the coupling slot is provided on one sidewall of the second rectangular waveguide portion.

2. The waveguide power divider according to claim 1 configured by:

a first metal sheet that becomes a wide wall of the first rectangular waveguide portion facing the shared common wide wall;

a second metal sheet that becomes both sidewalls of the first rectangular waveguide portion and the end portion set as the short-circuit surface;

a third metal sheet that becomes the shared common wide wall provided with the coupling slot;

a fourth metal sheet that becomes the one sidewall and an opposite sidewall of the second rectangular waveguide portion, and the matching conductor formed in a projecting manner from the one sidewall into the second rectangular waveguide portion; and a fifth metal sheet that becomes a wide wall of the second rectangular waveguide portion facing the shared common wide wall.

3. The waveguide power divider according to claim 2, wherein the first to fifth metal sheets each have a two-dimensional shape.

4. The waveguide power divider according to claim 1, wherein the short-circuit surface is located beyond the coupling slot at a position of about ¼ of a waveguide wavelength from a longitudinal-direction center of the coupling slot along the common longitudinal-direction of the coupling slot, the matching conductor is provided at a position offset by a predetermined distance from the longitudinal-direction center of the coupling slot in the common longitudinal-direction, and the predetermined distance is set according to a desired power distribution ratio within a range of a slot length in the common longitudinal-direction of the coupling slot.

5. A method of manufacturing a waveguide power divider, comprising the steps of:

preparing a first metal sheet that becomes a wide wall of a first rectangular waveguide;

preparing a second metal sheet having a predetermined sheet thickness to become both sidewalls of the first rectangular waveguide and an end portion set as a short-circuit surface of the first rectangular waveguide;

preparing a third metal sheet formed with a coupling slot;

preparing a fourth metal sheet having a predetermined sheet thickness to become both sidewalls of a second rectangular waveguide, and a matching conductor part projected into an interior portion of the second rectangular waveguide;

preparing a fifth metal sheet that becomes a wide wall of the second rectangular waveguide;

positioning the coupling slot provided in the third metal sheet such that a longitudinal direction of the coupling slot is in parallel with a common longitudinal direction of the first and second rectangular waveguides with the matching conductor part provided as a part of the fourth metal sheet being positioned near the coupling slot, and the short-circuit surface of the first rectangular waveguide being provided by the end portion of the second metal sheet located at a position about ¼ of a waveguide wavelength distance from a center of the coupling slot along the longitudinal direction of the coupling slot; and performing, after completing the step of positioning, diffusion bonding by sequentially stacking from the first metal sheet to the fifth metal sheet in this order.

6. The method of manufacturing a waveguide power divider according to claim 5, wherein in the step of positioning, the matching conductor is provided at a position offset by a predetermined distance from the longitudinal-direction center of the coupling slot in the common longitudinal-direction, and the predetermined distance is set according to a desired power distribution ratio within a range of a slot length in the common longitudinal-direction of the coupling slot.

7. The method of manufacturing a waveguide power divider according to claim 5, wherein the first to fifth metal sheets each have a two-dimensional shape.

* * * * *